US005638610A

United States Patent [19]

Resch

[11] Patent Number: 5,638,610

[45] Date of Patent: Jun. 17, 1997

[54] HEAT SETTING CHAMBER FOR THE CONTINUOUS HEAT SETTING OF YARNS

[75] Inventor: Ludwig Resch, Töging, Germany

[73] Assignee: Michael Hörauf Maschinenfabrik GmbH & Co. KG, Donzdorf, Germany

[21] Appl. No.: 638,829

[22] Filed: Apr. 29, 1996

[30] Foreign Application Priority Data

May 3, 1995 [DE] Germany ..... 195 16 127.0

[51] Int. Cl.[6] ..... F26B 5/04

[52] U.S. Cl. ..... 34/414; 34/444; 34/633; 34/634; 34/639

[58] Field of Search ..... 34/61, 147, 629, 34/633, 634, 639, 645, 414, 444, 448; 28/219, 220, 221, 249, 266

[56] References Cited

U.S. PATENT DOCUMENTS

| | | | |
|---|---|---|---|
| 3,955,287 | 5/1976 | Brock et al. | 34/155 |
| 3,991,482 | 11/1976 | Brock et al. | 34/155 X |
| 4,011,663 | 3/1977 | Moyer | 34/155 |
| 4,075,875 | 2/1978 | Heidan | 34/224 X |
| 4,513,514 | 4/1985 | Steiner | 34/462 |
| 4,638,572 | 1/1987 | Fleissner | 34/68 X |
| 5,189,810 | 3/1993 | Vetter | 34/419 |
| 5,210,961 | 5/1993 | Jacobs et al. | 34/155 |

FOREIGN PATENT DOCUMENTS

| | | |
|---|---|---|
| 1046758 | 1/1979 | Canada . |
| 1060573 | 12/1983 | U.S.S.R. . |

*Primary Examiner*—John M. Sollecito
*Assistant Examiner*—Steve Gravini
*Attorney, Agent, or Firm*—Evenson McKeown Edwards & Lenahan, PLLC

[57] ABSTRACT

In the case of a heat setting chamber for the continuous heat setting of yarns, entry and exit openings are provided, through which transport belts are fed and onto which transport belts the yarns are placed in loops. In the area of the entry and exit openings, ventilation seals are provided, on which the heat setting medium flows against the loops from underneath. The mouths of extractor vents are arranged vertically over the ventilation seals. The heat setting medium can thus penetrate the yarn loops in the area of the entry and exit openings simultaneously from above and below.

24 Claims, 4 Drawing Sheets

HEAT SETTING CHAMBER FOR THE CONTINUOUS HEAT SETTING OF YARNS

BACKGROUND AND SUMMARY OF THE INVENTION

The present invention relates to a heat setting chamber for the continuous heat setting of yarns, comprising entry and exit openings for transport belts which transport the yarns in loops, also comprising fans and flow guiding means for generating a circulation of superheated steam transversely to the transport direction of the yarns and directed at the loops. A feeder duct is provided for feeding steam, a heating system is provided for superheating the steam, extractor vents are provided for extracting a part of the steam arranged above the loops in the area of the entry and exit openings, and ventilation seals are provided underneath the loops in the area of the entry and exit openings, said ventilation seals being arranged inside the heat setting chamber and producing a counter-flow of steam directed against the loops.

A heat setting chamber of this general type is prior art in U.S. Pat. No. 4,513,514. In the case of the known heat setting chamber, socalled pre-zones are provided outside of the actual entry and exit openings and at which a part of the heat setting medium, in this case superheated steam, is extracted. The pre-zones are connected above the transport belts to exhaust steam vents, which extract upwards part of the steam circulating in the heat setting chamber. In the area of the pre-zones, but still inside the heat setting chamber, the steam, normally circulating from above, is re-routed in such a way that it circulates against the yarn loops from below in the so-called counter-flow principle, thus forming a ventilation seal. The result of this arrangement is that the lower area of the yarn loops practically only comes into contact with the superheated steam first inside the heat setting chamber, while in the upper area the yarn loops have already been heated by steam in the pre-zone. This results in the heat setting duration or the dwell time of the upper area of the loops being somewhat longer than for the lower area of the loops. The area of the loops which comes into contact with the heat setting medium first shrinks sooner than that area of the loops which comes into contact with the heat setting medium later. As the heating up of the upper area of the loops begins sooner, the loops reach the heat setting temperature sooner here than in their lower area. This can lead to a so-called marbled effect in finished fabric products, especially in carpets, which means that non-dyed yarns treated with superheated steam later color unevenly in the carpet. This is especially true for polyamid yarns. A further disadvantage in the known arrangement is that the superheated steam in the upper area of the loops is wetter than the steam which penetrates the lower area of the loops in the ventilation seal. This is because, as a result of extraction through the pre-zone, the superheated steam mixes a little with the cold air coming into the heat setting chamber and is thus cooled down. In the case of a very short heat setting chamber with a short dwell time, it can happen that the upper area of the yarn loops reaches a different heat setting temperature from the lower area of the yarn loops.

It is an object of the present invention to avoid the above mentioned disadvantages present in prior art, and to make a heat setting chamber in which the upper and lower areas of the yarn loops come into their first contact with the superheated steam simultaneously.

This object has been achieved in accordance with the present invention in that the mouths of the extractor vents are arranged essentially vertically over the ventilation seals and inside the heat setting chamber.

According to the present invention, the yarn loops first come into contact with the superheated steam only after they have fully entered the heat setting chamber, and then simultaneously in the upper and lower areas. In the lower areas the yarn loops are heated by the counter-flow of the ventilation seals, while a practically identical superheated steam is extracted vertically over the ventilation seals up through the upper area of the loops. This results in the yarn entering the heat setting chamber being shrunk or bulked simultaneously in all areas of the loops. Furthermore, all areas of the loops can reach the same heat setting temperature simultaneously. The same effect is achieved when the transport belts with the loops placed thereon are fed through the exit openings. Here all areas of the loops come into contact simultaneously with the superheated steam for the last time. It is further avoided that parts of the yarn loops come into contact with varying steam wetness.

It is advantageous that the mouths of the extractor vents extend essentially over the entire operational surface of the loops. This ensures that the steam flow of the ventilation seal is extracted in equal flow widths.

The cross section of the extractor vents can be advantageously varied by means of a cover plate according to certain preferred embodiments of the invention. The intensity of the extraction can thus be adapted to the intensity of the counter-flow of the ventilation seal.

In certain preferred embodiments of the invention, in the area of the ventilation seals, additional ventilation flows can be directed laterally against the loops. Thus the loops are not just penetrated with superheated steam in their upper and lower areas, but also sideways.

For the purpose of the present invention, the extractor vents are connected to an extractor channel which extends transversely outside of the heat setting chamber, and has a smooth, uninsulated floor surface arranged above the entry and exit openings. If the floor of the extractor channel is not insulated the floor surface can heat up to over 120° C. due to the high temperature of the exhaust steam, so that no condensation can form at this point.

As desired, suction mouths, disposed on the floor surface and arranged at both the entry and exit openings, can be additionally provided according to preferred embodiments. These additional suction mouths, which are superfluous in most cases, can take up the rest of the exhaust steam which is not extracted by the extractor vents. Thus a small amount of exhaust steam passes out through the entry and exit openings and into the extractor channel.

Other objects, advantages and novel features of the present invention will become apparent from the following detailed description of the invention when considered in conjunction with the accompanying drawings.

BRIEF DESCRIPTION OF TEE DRAWINGS

DETAILED DESCRIPTION OF THE DRAWINGS

Figure 1:
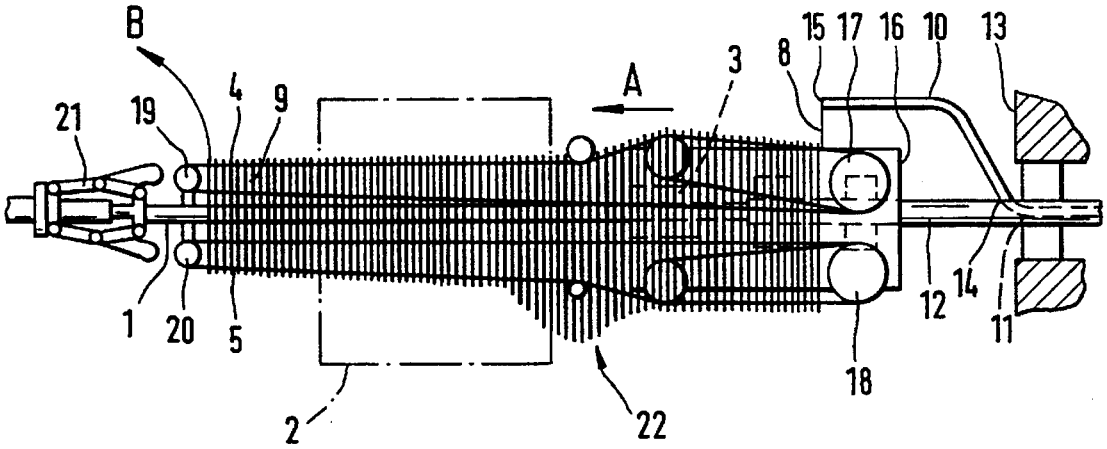
FIG. 1 is a schematic side view of a transport device of a yarn heat setting device with a schematic dash line showing of a heat setting chamber of the type to be utilized with the present invention.

The yarn heat setting device according to FIG. 1 comprises a plurality of central masts 1, preferably four to six, arranged one beside the other, of which only one central mast 1 is recognizable in the side view in FIG. 1. Each central mast 1 is a component of a transport device, which is guided through a heat setting chamber 2, indicated only by a dot-dash line. The central mast 1 is supported in a mounting 3 at one end (in FIG. 1 at its right end) and at the other end is either freely projecting or additionally supported from underneath by a supporting device (not shown).

Each central mast 1 is fitted with four transport belts 4,5,6 and 7 (see also FIGS. 3 and 4), of which only two transport belts 4 and 5 are visible in FIG. 1. These transport belts 4 to 7 are arranged in polygonal form around the central mast 1, as will become clear from FIGS. 3 and 4 to be described below. Their purpose is to transport in transport direction A at least one yarn 8, which is wound around the central mast 1 and the transport belts 4 to 7 in the form of loops 9. Preferably a plurality of yarns 8 can be provided, for example four to six yarns per central mast 1. This arrangement serves to transport the greatest possible number of yarns 8 with a pre-determined dwell time continuously through the heat setting chamber 2.

The depositing of the loops 9 takes place by means of a winding flyer 10, which is arranged in the area of the supported end of the central mast 1. The winding flyer 10 begins in a shaft 12 provided with an axial bore hole 11, which shaft 12 is supported in a housing 13 coaxially to the central mast 1. The axial bore hole 11 runs into a radial opening 14 of the shaft 12 and graduates into the crank-like, hollow winding flyer 10, which together with the shaft 12, is driven to rotate. The yarn 8 to be transported is fed through the axial bore hole 11 in transport direction A and exits through the mouth 15 of the winding flyer 10. Due to the rotational movements of the winding flyer 10, the yarn 8 is wound around the transport belts 4 to 7, which belts each preferably have a round cross section.

A gear housing 16 is supported on the shaft 12 which housing 16 does not rotate with the shaft 12 due to known means (not shown here) and which comprises the drive for the transport belts 4 to 7. The above mentioned mounting 3 for the supported end of the central mast 1 is provided in the gear housing 16.

Driven upper and lower guiding rollers 17 and 18 for the transport belts 4 to 7 are provided on the gear housing 16 for the transport belts 4 to 7. Freely rotatable upper and lower guiding rollers 19 and 20 for the transport belts 4 to 7 are arranged in the area of the projecting end of the central mast 1. Shortly before reaching the guiding rollers 19 and 20, the loops 9 of the yarn 8 are unravelled, drawn off in arrow direction B and fed to a winder machine in a way not shown here. The guiding rollers 19 and 20 are supported in such a way that the distance between them is adjustable by means of a tensioning device 21

Before reaching the heat setting chamber 2, the above mentioned polygon of the transport belts 4 to 7 is reduced by means of tension rollers or similar devices, so that the ensuing shrinkage of the yarns 8 in the heat setting chamber 2 is taken into consideration. Because of this it is indicated in FIG. 1 that the loops 9 hang down freely from the lower transport belts 5 and 6 in the entry area 22 of the heat setting chamber 2 and are only shortened inside the heat setting chamber 2 after a certain time to such an extent that they fit tightly again on the transport belts 4 to 7.

Figure 2:
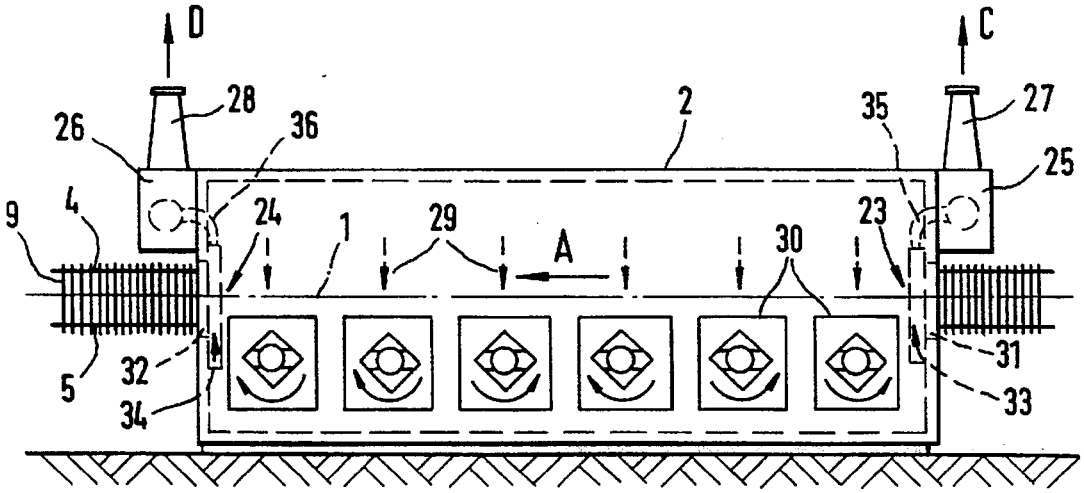
FIG. 2 is a side schematic view from the outside of a heat setting chamber constructed according to a preferred embodiment of the present invention.

In FIG. 2, which shows the side of a heat setting chamber 2 from the outside, a central mast 1 is indicated only by a dot-dash line and is arranged horizontally, the transport direction of the yarns 8 extending according to arrow direction A.

In the area of the entry openings 31 and the exit openings 32 for the central mast 1 and the transport belts 4 to 7, there is respectively a so-called ventilation seal 23 or 24, which serves to seal the heat setting chamber 2 against the outside air. While the heat setting medium, in the present case superheated steam, circulates in a flow 29 (FIG. 4) in a way which will be described below and penetrates the loops 9 from above transversely to the transport direction A, the flow in the area of the ventilation seals 23 and 24, also to be described below, is directed in such a way that a counter-flow 33 or 34 arises. The circulatory flow 29 and the counter-flow 33 and 34 are effected by preferably six fans 30, which rotate according to the denoted arrow directions.

Above each ventilation seal 23 and 24 an extractor vent 35 and 36 are located respectively, which extract a part of the circulating steam. These extractor vents 35 and 36 form the basis of the invention and will be explained in more detail below.

The extractor vents 35 and 36 each lead into an extractor channel 25 or 26, which is disposed transversely to the heat setting chamber 2, but which however lies outside of it. Two outlet openings 27 and 28 are connected thereto, through which the waste steam is released according to arrow directions C and D.

Figure 3:
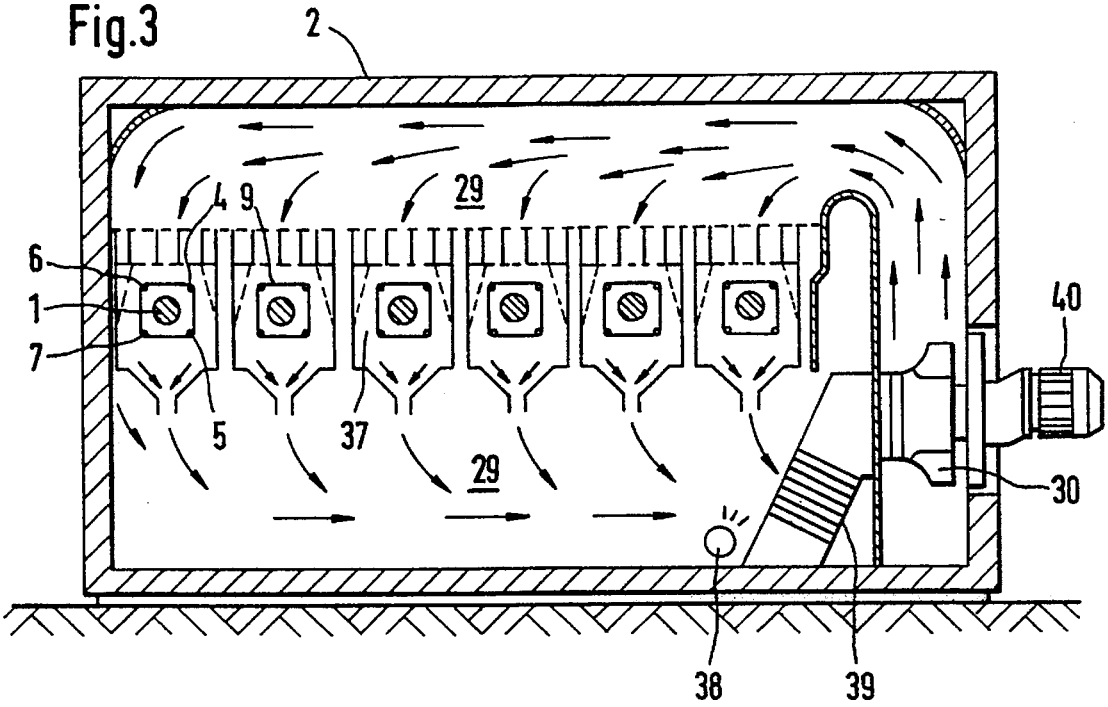
FIG. 3 is a cross sectional view of the heat setting chamber of the arrangement of FIG. 2.

Inside of the heat setting chamber 2 there is, as shown in FIG. 3, a so-called trapezoidal channel 37 for each central mast 1, the cross section of the channel 37 is trapezoidal in form and consists essentially of the perforated sheet metal surrounding the transport belts 4 to 7. A so-called three-sided ventilation for the loops 9 of the yarn 8 is achieved by means of this trapezoidal channel 37.

There is a feeder tube 38 located in the inside of the heat setting chamber 2 for replacing steam, which tube 38 extends in longitudinal direction of the heat setting chamber 2. The feeder tube 38 is located underneath the transport belts 4 to 7 and extends near to an electric heating system 39 which superheats the steam to the desired chamber temperature. By means of the fans 30, each driven by a motor 40, the superheated steam is forced to flow in a circulatory flow 29, as indicated by the plurality of arrows. The flow 29 penetrates from above through the loops 9 of the yarns 8 carried by the transport belts 4 to 7, whereby flow guiding means for generating the circulatory flow 29 are arranged to the individual central masts 1. These flow guiding means are known from the above mentioned prior art and do not need to be described further here.

While the circulatory flow 29 penetrates the loops 9 from above, a counter-flow 33 and 34 respectively is generated in the area of the ventilation seals 23 and 24 arranged to the entry and exit openings 31 and 32 respectively. These will be explained with the aid of FIG. 4.

In the area of each ventilation seal 23, 24, lateral guiding channels 41 and 42 are located beside the transport belts 4 to 7, through which channels the steam flows from above due to the circulating flow 29. This flow is re-directed underneath the loops 9 to flow in a horizontal line and can then penetrate the loops 9 from underneath in a counter-flow 33 or 34. A transverse channel 43 is provided in the above mentioned horizontal area, which is covered towards the top by a perforated floor plate 44. The counter-flow prevents superheated steam from escaping out into the open and cold air from getting into the heat setting chamber 2. The counter-flow 33 as well as a part of the circulating flow 29 are extracted through extractor vents 35 or 36 which will be described in more detail below. These extractor vents 35 and 36 are located essentially vertically over the relevant ventilation seals 23,24 inside the heat setting chamber 2. The mouths 45 of the extractor vents 35,36 located directly over the loops 9 extend essentially over the entire working width of a loop 9, denoted by E.

Figure 5:
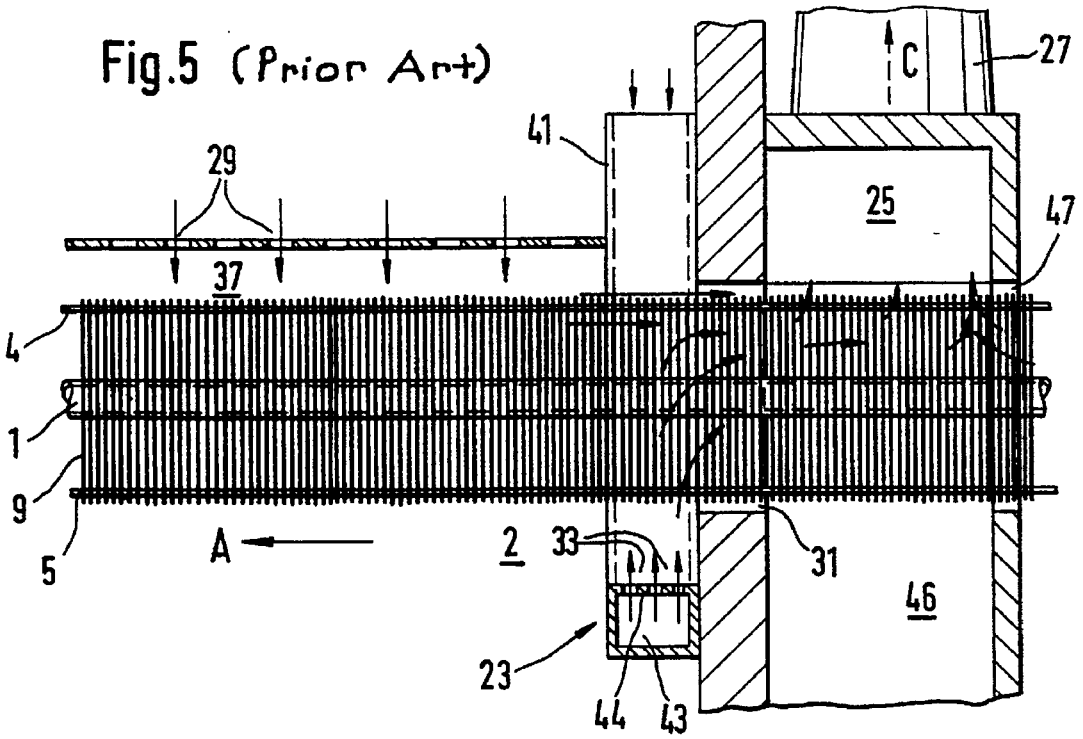
Fig.5 (Prior Art)
FIG. 5 is a longitudinal section of the area of a ventilation seal in a heat setting chamber as in the prior art.

In the case of the above mentioned prior art, represented to explain the problem in FIG. 5, the waste steam going into the outlet openings 27 and 28 is forced to flow exclusively through the entry openings 31 or the exit openings 32. The counter-flow directed from below against the loops 9 of the yarns 8 has to be re-directed through the entry opening 31 into the relevant extractor channel 25. To this end there is, in prior art, a so-called pre-zone 46 located outside the heatsetting chamber 2, to which pre-zone 46 a pre-zone inlet 47 is arranged. A corresponding pre-zone is also provided in the area of the exit openings 32.

Figure 6:
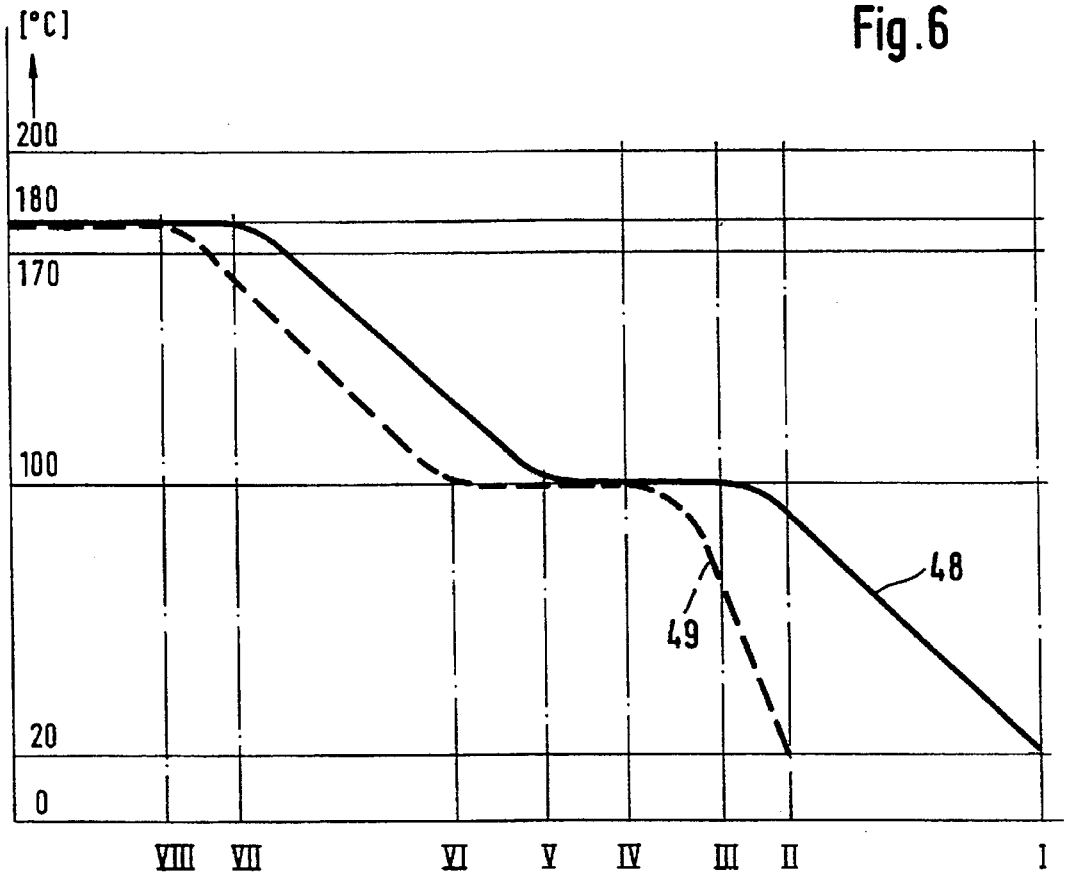
FIG. 6 is a diagram comparing the temperatures found in the known heat setting chamber and in the heat setting chamber according to the present invention.

From the diagram in FIG. 6, it can be seen that the arrangement according to FIG. 5 is, in many respects, disadvantageous.

The diagram represents the individual components in FIG. 5 and should be read from right to left. The abscissa is understood as a longitudinal extension through the pre-zone 46 and the heat setting chamber 2. Various areas of the heat setting chamber 2 are referred to by the Roman numerals I to VIII. On the ordinate, the temperatures which the yarn 8 reached at a particular point in the heat setting chamber 2 are listed in degrees Celcius. The curve 48, denoted by a continuous line, is applied to the upper area of the loops 9, that is the transport belts 4 and 6, the dotted curve 49 being allocated to the lower area of the loops 9, that is the transport belts 5 and 7. The yarns 8 are fed into the pre-zone 46 at a temperature of 20° C., which corresponds to the outside temperature, and then through the entry opening 31 into the heat setting chamber 2, where they are heated to a heat setting temperature of, for example, 180° C.

First, the curve 48, which applies to the upper area of the loops 9, will be considered:

At the point I, the yarns 8 enter the pre-zone 46 and heat up gradually from this point onwards, as in the area of the transport belts 4 and 6, a part of the circulating steam gets into the extractor channel 25 through the entry opening 31. The upper area of the loops 9 has then already reached a temperature of 100° C. near the entry opening 31, that is at the point III, at which temperature the yarns 8 remain for a while, namely until the yarns 8 are completely dry. Only then, from the point V inside the heat setting chamber 2, do the temperatures of the upper areas of the loops 9 gradually attain the heat setting temperature of 180° C., which is—supposedly—reached at the point VII.

The case is completely different for the lower area of the loops 9, that is in the area of the transport belts 5 to 7:

As the steam fed into the extractor channel 25 does not reach the lower area of the loops 9, the yarns 8 in the area of the transport belts 5 and 7 are first heated when they reach the area of the counter-flow 33 of the ventilation seal 23, that is after they have been fed through the entry opening 31 into the heat setting chamber 2. It is assumed that the heating up begins, starting at 20° C., at the point II which is located in the area of the entry opening 31. The lower area of the loops 9 reaches the 100° C. mark first at a point IV, which is located downstream of the ventilation seal 23, that is, at a much later point than the upper area of the loops 9 as shown by curve 48. It can be seen that the dotted-line curve 49 for the lower area of the loops 9 not only reaches the 100° C. mark later, it also leaves it later, so that it is only from a point VI, which is located further inside the heat setting chamber 2 than point V, that an increase in yarn temperature towards the heat setting temperature of 180° C. takes place. The heat setting temperature is thus reached first at point VIII, which is located significantly further inside the heat setting chamber 2 than point VII, at which the upper area of the loops 9 have reached the heat setting temperature. In the case of extremely short heat setting chambers 2, it can occur that the upper and lower areas of the loops 9 do not reach the same heat setting temperature.

This different behavior of the yarns 8 in the upper and lower areas of the loops 9 results in the area of the transport belts 4 and 6 having a longer dwell time in the superheated steam than the area of the transport belts 5 and 7. The effect of this can be seen especially in yarns which have not yet been dyed, and which are colored only later when the fabric product is finished, for example, carpets. This is particularly the case with polyamide yarns. The different heat setting behavior of the upper and lower areas of the loops 9 results later when dyeing in uneven coloring, which produces the so-called marbled effect.

An object of the present invention is to match the two differing curves 48 and 49 in FIG. 6 as far as is possible, that is, to ensure that for the upper as well as the lower areas of the loops 9 at least similar temperatures and possibly identical dwell times are present. This is achieved in practice in that the curve 48 is moved with the measurements according to FIG. 7 to the curve 49, so that the curve 49, represented by a dot-dash line, can be considered to be the common temperature curve for a heat setting chamber 2 according to the invention.

Figure 4:
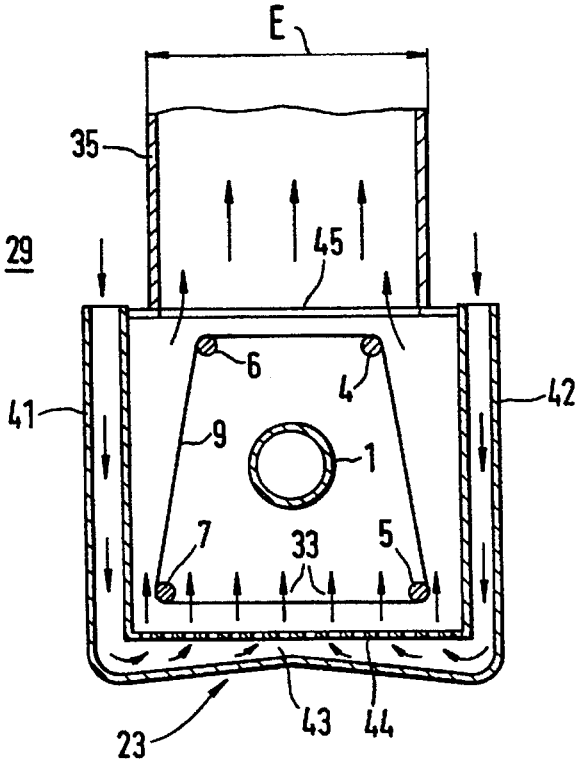
FIG. 4 is an enlarged drawing of a cross section of a part of the heat setting chamber of FIG. 3 in the area of a transport device and a ventilation seal.

As can be seen from FIG. 7, which shows the area of the entry opening 31, the circulating flow 29 inside the heat setting chamber 2 is re-routed into a counter-flow 33, already demonstrated with the aid of FIG. 4, by means of lateral guiding channels 41,42, in a way already described above, which counter-flow 33 penetrates the loops 9 of the yarns 8 with superheated steam from below. It should be mentioned at this point that the described arrangement for the area of the entry openings 31 applies also to the area of the exit openings 32.

Diverging from prior art, the counter-flow 33 is guided vertically upwards and extracted. To this end, an extractor vent 35 is arranged above the upper transport belts 4 and 6, whose mouth 45 extends over the entire working area E, as already described in FIG. 4. The extractor vent 35 (as well as the other extractor vent 36) is located essentially vertically over the respective ventilation seal 23 or 24 and inside the heat setting chamber 2. The lower areas of the loops 9 are penetrated by the counter-flow 33 and the upper areas of the loops 9 are penetrated by the exhaust steam at the same time. It is practically impossible that the upper area of the loops 9 is already heated long before it enters the inside of the heat setting chamber 2. The loops 9 are thus heated over their entire height in the same way by the same heat setting temperature.

The extractor vent 35 is guided into an extractor channel 25, which is arranged transversely to the heat setting chamber 2, yet outside of it. The cross section of the extractor vent 35 can be altered by means of an adjustable cover plate 50, in order to adapt the waste steam in its intensity to the counter-flow 33.

Furthermore, according to the present invention, the loops 9 are also penetrated from the side, namely by lateral ventilation flows 51 which lie also in the area of the same cross section in which the ventilation seal 23 and the extractor vent 35 are located.

In practice it has been shown that practically the entire exhaust steam can be extracted through the exhaust steam vent 35 (the same applies to the other exhaust steam vent 36 in the area of the exit opening 32). Consequently and according to the present invention, and diverging from the embodiment in FIG. 7, the floor surface 52 of the extractor channel 25 could be smooth and without insulation; this means that the floor surface 52 can heat up, namely to a temperature of approximately 120° C., which results in the underside of the floor surface 52 being incapable of forming condensation which could drop onto the yarns 8 being fed into the heat setting chamber 2.

Figure 7:
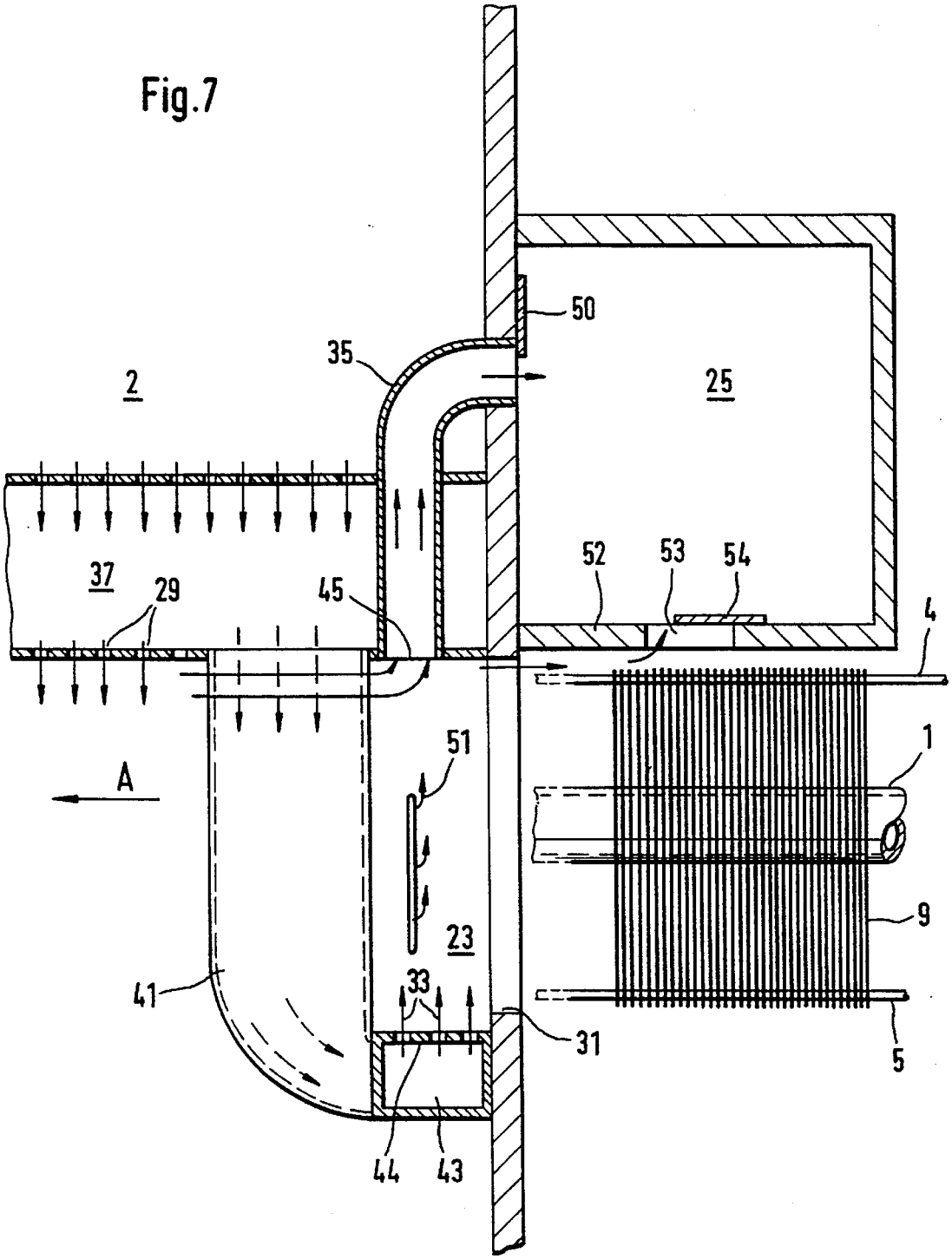
FIG. 7 is a longitudinal sectional view in the area of a ventilation seal of the heat setting chamber according to the present invention.

Alternatively, according to FIG. 7, it is in certain circumstances advantageous to provide an extractor mouth 53 on the floor surface 52, whose cross section is adjustable by means of a cover plate 54. A part of the remaining exhaust steam can, when required, be extracted through the entry opening 31 by the extractor mouth 53 into the extractor channel 25. However, as already mentioned, it has been shown in practice that, as a rule, the extractor mouth 53 can be omitted.

Finally it should be mentioned that the present invention is not limited to this type of central mast 1 and transport belts 4 to 7. Other completely different types of transport belts can be used, for example transport belts with a larger width on which yarn loops can be placed in ordered or random windings, as is often the case in frieze appliances.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of making yarn, using a heat setting chamber for the continuous heat setting of yarn of the type comprising:

entry and exit openings for transport belts which transport the yarn in loops, fans and flow guides generating a circulating flow of superheated steam directed transversely to a transport direction of the yarn and against the loops from above, ventilation seals arranged inside the heat setting chamber underneath the loops in the area of the entry and exit openings, each ventilating seal redirecting at least a portion of the flow of superheated steam directed against the loops from above to produce a counter-flow of steam directed upwardly against the loops, and extractor vents arranged above the loops in the area of the entry and exit openings for extracting at least a part of the steam, said extractor vents having extractor vent mouths arranged essentially vertically above the ventilation seals and inside the heat setting chamber so that the counterflow of superheated steam serves to uniformly heat upper and lower areas of the loops, said method including:

conveying yarn in loops through the heat setting chamber by the transport belts, utilizing said fans and flow guides to apply a circulating flow of superheated steam against the loops from above during said conveying, redirecting at least a portion of the flow of superheated steam by respective ones of said ventilation seals to produce a counterflow of steam directed upwardly against the loops in the area of the exit and entry openings, and extracting at least a part of the steam through the extractor vent mouths.

2. A heat setting chamber for the continuous heat setting of yarn comprising:

entry and exit openings for transport belts which transport the yarn in loops, fans and flow guides generating a circulating flow of superheated steam directed transversely to a transport direction of the yarn and against the loops from above, a ventilation seal arranged inside the heat setting chamber underneath the loops in the area of one of the entry and exit openings, said ventilation seal redirecting at least a portion of the flow of superheated steam directed against the loops from above to produce a counter-flow of steam directed upwardly against the loops, and an extractor vent arranged above the loops in the area of the one of the entry and exit openings for extracting at least a part of the steam, said extractor vent having an extractor vent mouth arranged essentially vertically above the ventilation seal and inside the heat setting chamber so that the counterflow of superheated steam serves to uniformly heat upper and lower areas of the loops.

3. A heat setting chamber according to claim 2, wherein the ventilation seal and associated extractor vent is arranged in the area of the entry opening.

4. A heat setting chamber according to claim 2, wherein the ventilation seal and associated extractor vent is arranged in the area of the exit opening.

5. A heat setting chamber for the continuous heat setting of yarn comprising:

entry and exit openings for transport belts which transport the yarn in loops, fans and flow guides generating a circulating flow of superheated steam directed transversely to a transport direction of the yarn and against the loops from above, ventilation seals arranged inside the heat setting chamber underneath the loops in the area of the entry and exit openings, each ventilation seal redirecting at least a portion of the flow of superheated steam directed against the loops from above to produce a counter-flow of steam directed upwardly against the loops, and extractor vents arranged above the loops in the area of the entry and exit openings for extracting at least a part of the steam, said extractor vents having extractor vent mouths arranged essentially vertically above the ventilation seals and inside the heat setting chamber so that the counterflow of superheated steam serves to uniformly heat upper and lower areas of the loops.

6. A heat setting chamber according to claim 5, wherein the mouths extend essentially over an entire working width of the loops.

7. A heat setting chamber according to claim 5, wherein the cross sections of the extractor vents are adjustable by means of a cover plate.

8. A heat setting chamber according to claim 6, wherein the cross sections of the extractor vents are adjustable by means of a cover plate.

9. A heat setting chamber according to claim 5, wherein, in the area of the ventilation seals, additional ventilation flows directed laterally against the loops are provided.

10. A heat setting chamber according to claim 6, wherein, in the area of the ventilation seals, additional ventilation flows directed laterally against the loops are provided.

11. A heat setting chamber according to claim 7, wherein, in the area of the ventilation seals, additional ventilation flows directed laterally against the loops are provided.

12. A heat setting chamber according to claim 8, wherein, in the area of the ventilation seals, additional ventilation flows directed laterally against the loops are provided.

13. A heat setting chamber according to claim 5, wherein the extractor vents are connected to an extractor channel which extends outside the heat setting chamber and transversely thereto and comprises a smooth, uninsulated floor surface arranged above the entry openings and the exit openings.

14. A heat setting chamber according to claim 6, wherein the extractor vents are connected to an extractor channel which extends outside the heat setting chamber and transversely thereto and comprises a smooth, uninsulated floor surface arranged above the entry openings and the exit openings.

15. A heat setting chamber according to claim 7, wherein the extractor vents are connected to an extractor channel which extends outside the heat setting chamber and transversely thereto and comprises a smooth, uninsulated floor surface arranged above the entry openings and the exit openings.

16. A heat setting chamber according to claim 8, wherein the extractor vents are connected to an extractor channel which extends outside the heat setting chamber and transversely thereto and comprises a smooth, uninsulated floor surface arranged above the entry openings and the exit openings.

17. A heat setting chamber according to claim 9, wherein the extractor vents are connected to an extractor channel which extends outside the heat setting chamber and transversely thereto and comprises a smooth, uninsulated floor surface arranged above the entry openings and the exit openings.

18. A heat setting chamber according to claim 12, wherein the extractor vents are connected to an extractor channel which extends outside the heat setting chamber and transversely thereto and comprises a smooth, uninsulated floor surface arranged above the entry openings and the exit openings.

19. A heat setting chamber according to claim 13, wherein an extractor mouth disposed on the floor surface is arranged respectively at the entry openings and the exit openings.

20. A heat setting chamber according to claim 14, wherein an extractor mouth disposed on the floor surface is arranged respectively at the entry openings and the exit openings.

21. A heat setting chamber according to claim 15, wherein an extractor mouth disposed on the floor surface is arranged respectively at the entry openings and the exit openings.

22. A heat setting chamber according to claim 16, wherein an extractor mouth disposed on the floor surface is arranged respectively at the entry openings and the exit openings.

23. A heat setting chamber according to claim 17, wherein an extractor mouth disposed on the floor surface is arranged respectively at the entry openings and the exit openings.

24. A heat setting chamber according to claim 18, wherein an extractor mouth disposed on the floor surface is arranged respectively at the entry openings and the exit openings.

* * * * *